US006101843A

United States Patent [19]

Nagano

[11] Patent Number: 6,101,843

[45] Date of Patent: Aug. 15, 2000

[54] DOUBLE-STRUCTURE RING

[76] Inventor: Tomohisa Nagano, 2223-3, Tamagashi, Okayama-shi, Okayama 701-21, Japan

[21] Appl. No.: 09/068,069

[22] PCT Filed: Oct. 28, 1997

[86] PCT No.: PCT/JP97/03913

§ 371 Date: May 1, 1998

§ 102(e) Date: May 1, 1998

[87] PCT Pub. No.: WO98/19574

PCT Pub. Date: May 14, 1998

[30] Foreign Application Priority Data

Nov. 7, 1996 [JP] Japan ..... 8-332689

[51] Int. Cl.[7] ..... A44C 9/00

[52] U.S. Cl. ..... 63/15.4; 63/29.2; 63/15.3

[58] Field of Search ..... 63/15, 15.1, 15.2, 63/15.3, 15.4, 29.2, 900

[56] References Cited

U.S. PATENT DOCUMENTS

| | | | |
|---|---|---|---|
| 1,333,284 | 3/1920 | Schreiber | 63/15 X |
| 1,599,811 | 9/1926 | Eliasoff | 63/15 |
| 2,060,345 | 11/1936 | Phillips | 63/15 X |
| 2,241,165 | 5/1941 | Shelton | 63/15 |
| 3,670,525 | 6/1972 | Mulligan | 63/23 |
| 4,052,864 | 10/1977 | Hofsaess | 63/31 |
| 4,424,689 | 1/1984 | Saito | 63/15.1 |
| 5,367,891 | 11/1994 | Furuyama | 63/29.2 |
| 5,678,428 | 10/1997 | Pasquetti | 63/15.1 X |

*Primary Examiner*—Terry Lee Melius
*Assistant Examiner*—Andrea Chop
*Attorney, Agent, or Firm*—Vedder Price Kaufman & Kammholz

[57] ABSTRACT

A finger ring which is not only outstanding as an accessory but provides the fun of toying with and the benefit of diversion. This double-ring finger ring comprises an inner ring and an outer ring, with magnets mounted in an outer circumferential region of the inner ring and in an inner circumferential region of the outer ring with their like poles facing each other.

11 Claims, 5 Drawing Sheets

DOUBLE-STRUCTURE RING

TECHNICAL FIELD

This invention relates to a finger ring comprising an outer ring and an inner ring and, more particularly, to a finger ring, the outer ring of which is held in suspension by the repellent force of magnets.

PRIOR ART

The finger ring as an accessory is available in a broad assortment including expensive rings to low-priced rings. Even toy rings are available for children. However, they are mere accessories or toys and have no other functions.

The present invention has for its object to provide a double-ring finger ring which, in addition to the conventional ornamental value, offers the fun of toying with and the benefit of diversion.

DISCLOSURE OF THE INVENTION

The finger ring according to this invention comprises an outer ring, an inner ring, and a plurality of magnets secured to the outer circumferential region of the inner ring and the inner circumferential region of the outer ring, respectively.

The magnets of the inner ring and the magnets of the outer ring are preferably disposed circumferentially in such a manner that all the magnets that may form pairs mate concurrently. Furthermore, the magnets of the inner ring and the magnets of the outer ring are preferably oriented alike in polarity, in which case the outer ring can be held in suspension.

The inner ring preferably has an extension at either axial end, in which case the outer ring is precluded from being completely disengaged from the inner ring. More preferably, said extension is continual in the circumferential direction, in which case not only the disengagement of the outer ring can be positively prevented but also the aesthetic value of the finger ring is improved.

BEST MODE FOR CARRYING OUT THE INVENTION

The present invention is now described in further detail with reference to the preferred embodiments illustrated in several views of the accompanying drawing.

Figure 1:
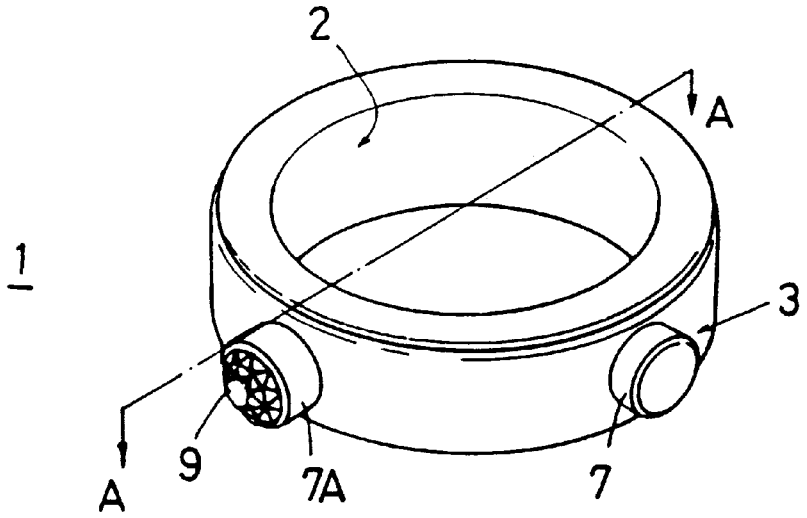
FIG. 1 is a perspective view of a finger ring embodying the principle of the invention.

Referring to FIG. 1 which illustrates a double-ring finger ring embodying the principle of the invention, the ring 1 comprises a circular inner ring 2 and a circular outer ring 3, with the outer ring 3 being held in suspension externally of the inner ring 2. As mentioned above, the finger ring of this invention is useful not only as an accessory but also as a toy. Thus, both the inner ring 2 and outer ring 3 of the finger ring for ornamental use can be made of noble metal such as gold, silver, or platinum, while the inner ring 2 and outer ring 3 of the finger ring for use as a toy can be made of an inexpensive metal or synthetic resin material.

Figure 2:
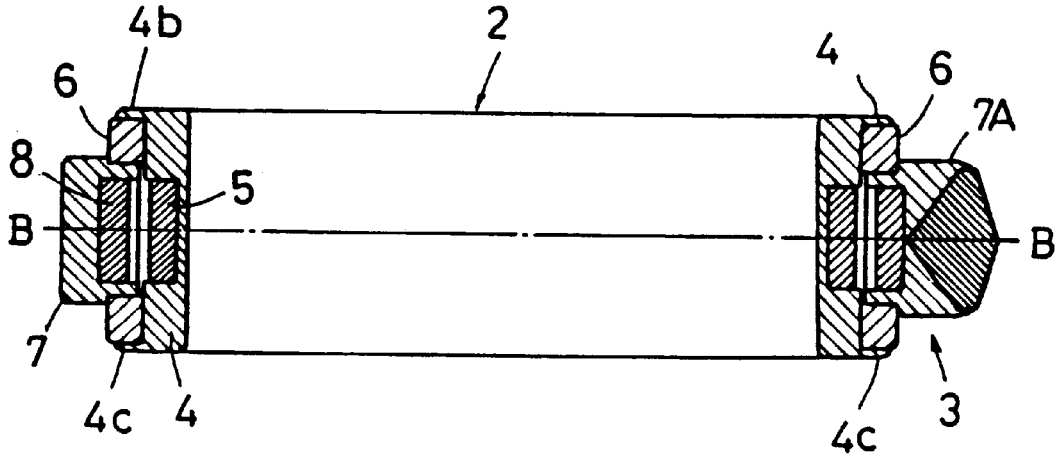
FIG. 2 is a sectional view taken along the line A—A of FIG. 1.
Figure 3:
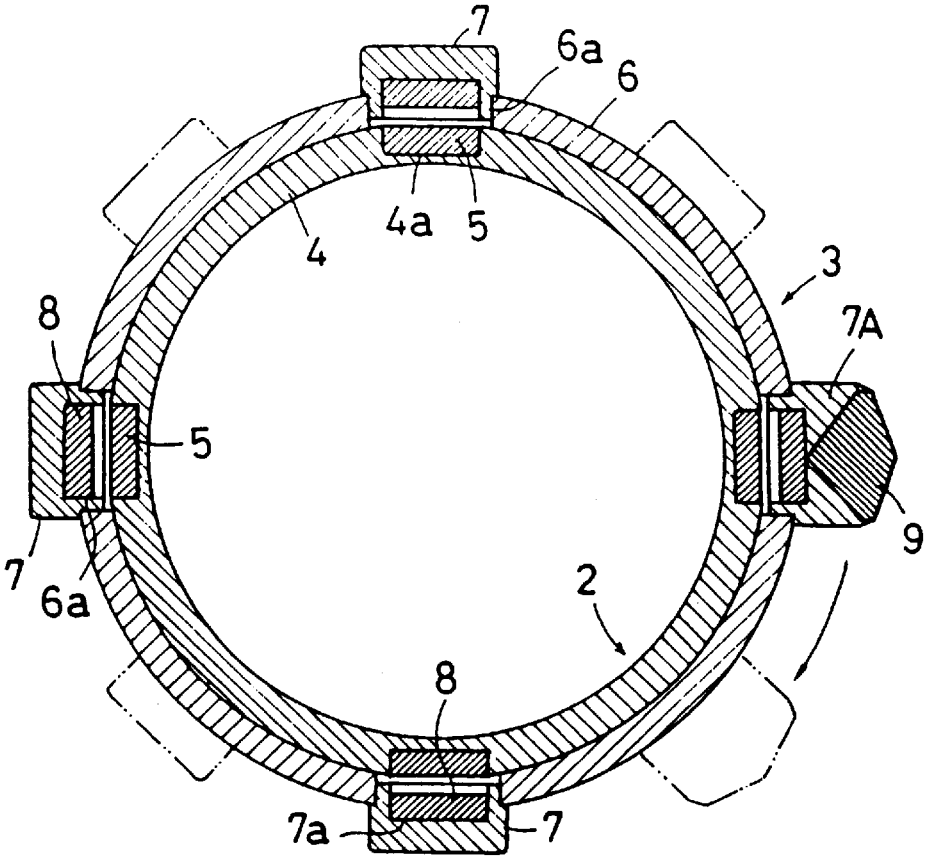
FIG. 3 is a sectional view taken along the line B—B of FIG. 2.

As shown in FIGS. 2 and 3, the circular inner ring 2 comprises an inner ring body 4 and four permanent magnets 5 each embedded in the outer circumferential region of the inner ring body 4. The inner ring body 4 is formed with four circular grooves 4*a* at circumferentially equal pitches. The four magnets 5 are cylindrical elements conforming to said circular grooves 4*a* and, after insertion into the grooves, are locked in position with an adhesive. The magnets 5 should be uniform in orientation with respect to polarity and, in the illustrated finger ring, the outer circumferential part of each magnet which faces the outer ring 3 constitutes an N-pole while the inner circumferential part constitutes an S-pole.

As shown detailedly in FIG. 2, the inner ring body 4 is generally configured in the form of the letter U, with its axial end extensions 4*b*, 4*c* (top and bottom ends in the view of FIG. 2) being respectively continuous in the circumferential direction of the ring 4. Before assembling the inner ring 2 with the outer ring 3, the inner ring 2 is in the form shown in FIG. 4, with the projection 4*b* extending axially (vertically in the view of FIG. 4).

The outer ring 3 comprises an outer ring body 6 which is slightly smaller in axial dimension than the inner ring body 4, four mounting members 7 (7A) secured to said outer ring body 6, and magnets 8 mounted in said mounting members 7 (7A), respectively. As can be readily seen, the inner diameter of the outer ring body 6 is slightly larger than the outer diameter of the inner ring body 4 so that the outer ring 3 may rotate around the inner ring 2. The outer ring body 6 is formed with four circular holes 6*a* at circumferentially equal pitches. These circular holes 6*a*, radially extending through the outer ring body 6, are situated in the positions corresponding to the circular grooves 4*a* of the inner ring 4.

In detail, the mounting members 7 are classifiable into a mounting member 7A for accommodating a precious stone or the like 9 and the other mounting members 7 but all the mounting members 7 are generally cylindrical. Each magnet 8, which is also cylindrical, is mounted in the circular groove 7*a* formed in the bottom of the mounting member 7 (7A) and secured in position with an adhesive. As mounted, the magnets 8 should be alike in polarity and, in the illustrated embodiment, the inner circumferential part of each magnet 8 which faces the inner ring 2 constitutes an N-pole, while the outer circumferential part constitutes an S-pole. The mounting member 7 (7A) with the magnet set therein is inserted into the circular hole 6*a* of the outer ring body 6 and secured rigidly in position by, for example, brazing.

The procedure for completing the finger ring 1 of the above construction is now described. First, the mounting members 7 accommodating the magnets 8 are set in the circular holes 6*a* of the outer ring body 6. Similarly, magnets 5 are set in the circular grooves 4*a* of the inner ring body 4. In this stage, the extension 4*b* of the inner ring body 4 remains extending axially (FIG. 4).

Figure 4:
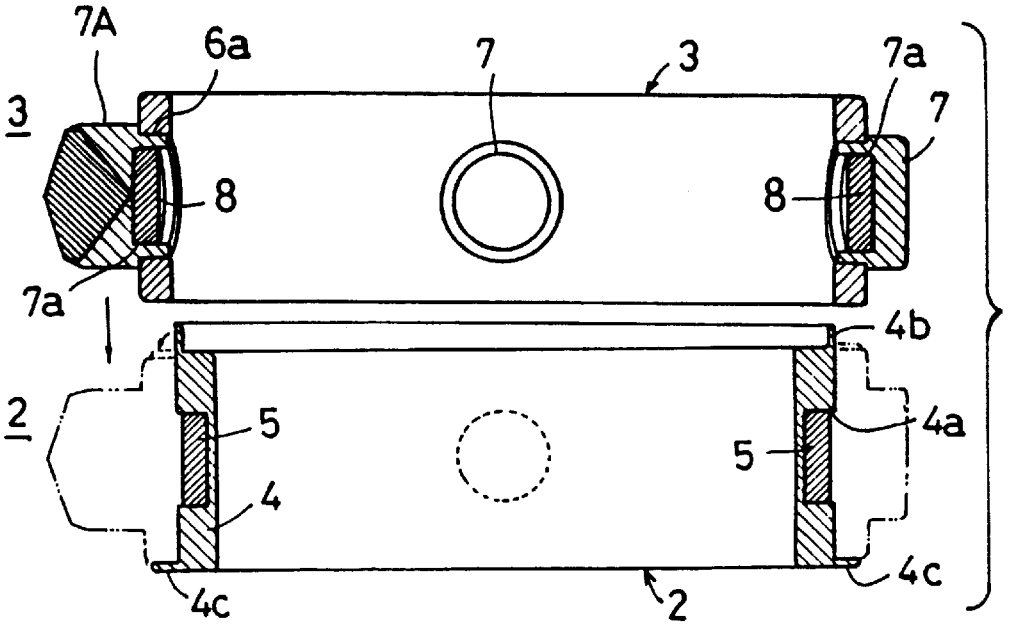
FIG. 4 is a view illustrating the manufacturing process.
Figure 5:
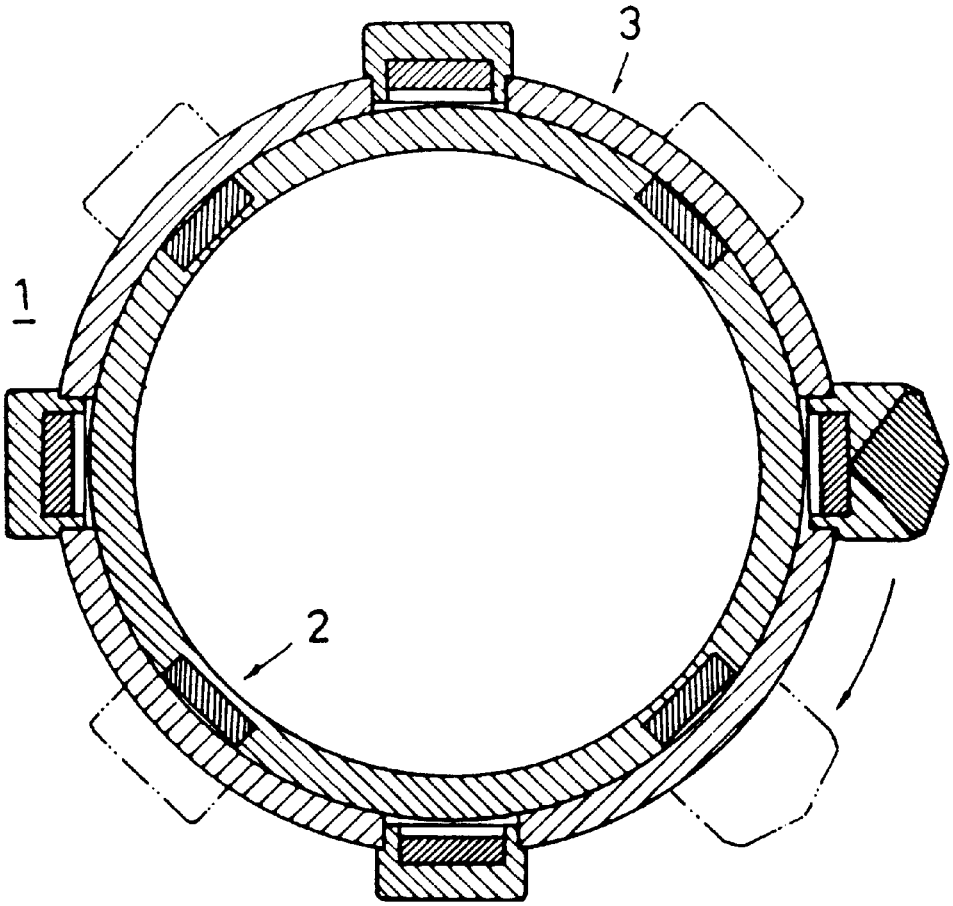
FIG. 5 is a view illustrating the method of use of the finger ring.

Then, as shown by the arrowmark in FIG. 4, the outer ring 3 is set in position around the inner ring 2 and the extension 4*b* is bent radially outward, whereupon the inner ring body 4 is formed generally into the shape of the letter U. As mentioned above, the magnets 8 of the outer ring and the magnets 5 of the inner ring have been accommodated with their N poles facing each other. Therefore, in this completely assembled condition, the magnets 5 and 8 repel each other to cause the outer ring to shift in the direction of the arrowmark in FIG. 3 and bring it into the condition shown in FIG. 5. As a result, the outer ring 3 is held in suspension around the inner ring 2.

After the finger ring 1 thus completed is worn on a finger, the outer ring 3 can be caused to rotate in a random fashion around the inner ring 2, with the result that the finger ring may serve to sedate the wearer in irritable condition. Thus, when one is in a wistful mood due to abstention from smoking or in awkward suspense, she may rotate the outer ring 3 through more than 45 degrees against the magnetic force (in the direction of the arrowmark in FIG. 5). Then, the outer ring by itself turns further through 45° owing to the repellent force of the magnets. Therefore, this discontinuous random rotation produces a sedative effect by diverting her attention to the fingertip.

According to Oriental medicine, it is known that pressing the so-called effective spot of the hand or the finger with a small protuberant body has a tranquillizing effect. Therefore, merely pressing the precious stone 9 on the mounting member 7A against the effective spot of the hand or finger results in a sedative effect.

Moreover, since the finger ring of this invention displays a novel behavior, that is to say the random rotation of the outer ring 3, it can be utilized as a toy. Since the mounting member 7 is projecting radially outward, it can serve effectively as an operating lever for rotating the outer ring 3.

While a preferred embodiment of this invention has so far been described, many changes and modifications can be made without departing from the spirit and scope of the invention. Thus, since the principle of the present invention lies in the feasibility of retaining the outer ring in rotatable condition, the above embodiment can be freely modified in other aspects.

Figure 6:
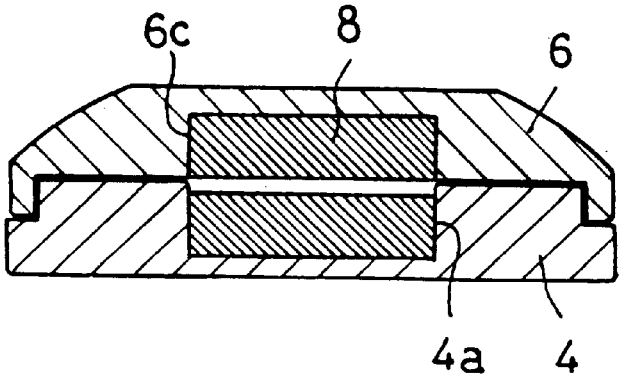
FIG. 6 is a view illustrating another embodiment of the invention.

For example, although the inner ring body 4 is formed generally in the U-configuration to retain the outer ring body 6 in the above embodiment, conversely the outer ring body 6 may be formed generally in the shape of the letter U to hold the inner ring body 4 as illustrated in FIG. 6.

Figure 7:
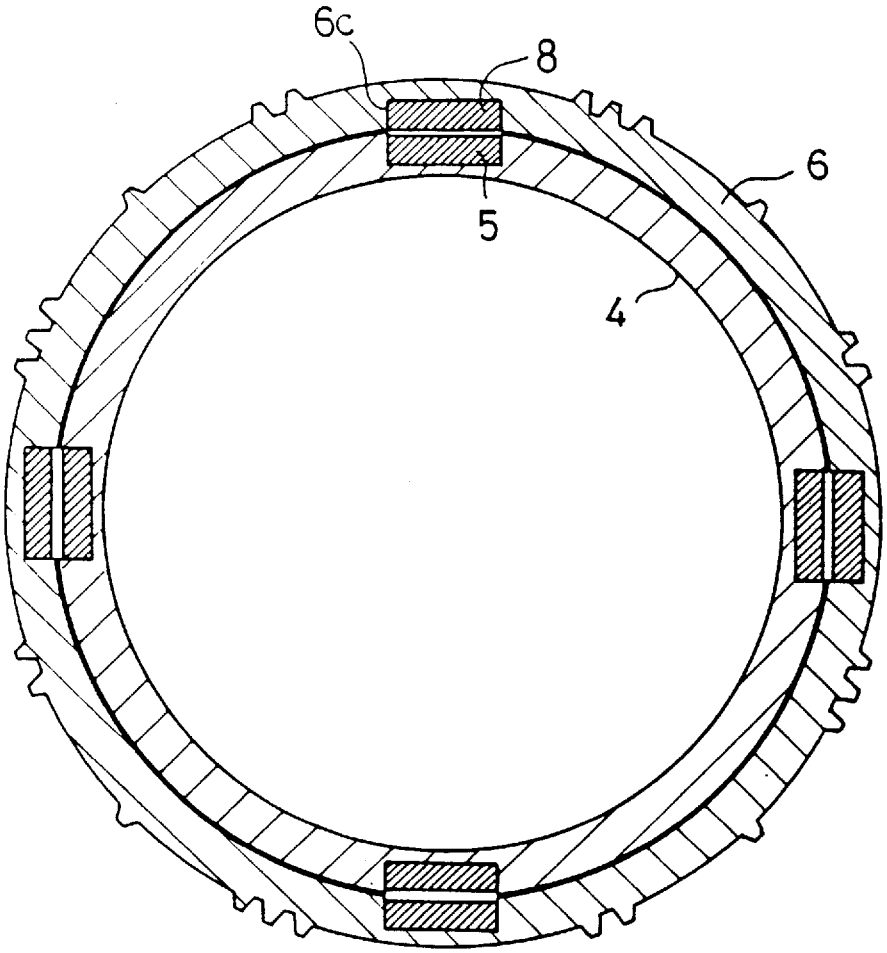
FIG. 7 is a view corresponding to FIG. 3, which illustrates said another embodiment.

Moreover, the ornament on the outer ring side can be changed as desired. For example, instead of attaching a precious stone 9 as in the above embodiment, the outer ring 3 may be formed as a simple ring as shown in FIG. 7. When such a simple ring is used, the outer ring body 6 need only be formed with circular grooves 6*c* and magnets 8 be set in the grooves. In this case, the mounting members 7 can be omitted.

It should also be understood that the number and arrangement of magnets mentioned for the above embodiment are by no means limitative of the invention. Of course, the magnets may be disposed with their S-poles facing each other in lieu of the N-poles facing each other in the embodiment. In any event, when the magnets are disposed with the like poles facing each other, a repulsive force acts between two magnets of each pair so that even if the bonding force of the adhesive is weak, the magnets will not be easily dislodged.

Figure 8:
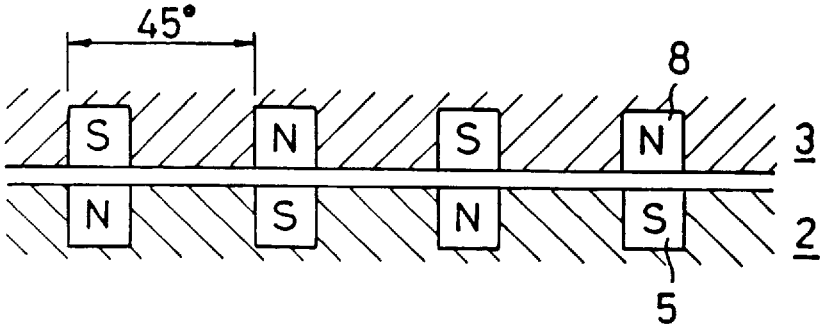
FIG. 8 is a view illustrating the manner in which magnets are arranged.

When the magnetic force of magnets is not so strong, the N- and S-poles may be arranged face-to-face as shown in FIG. 8. In this case, the finger ring is retained in static condition as shown but when one rotates the outer ring through more than 45°, the outer ring turns further through 45 degrees under the repelling force of magnets so that the stable state with N- and S-poles facing each other is reestablished. Thus, even in the arrangement illustrated in FIG. 8, the outer ring may rotate in a random fashion.

Figure 9:
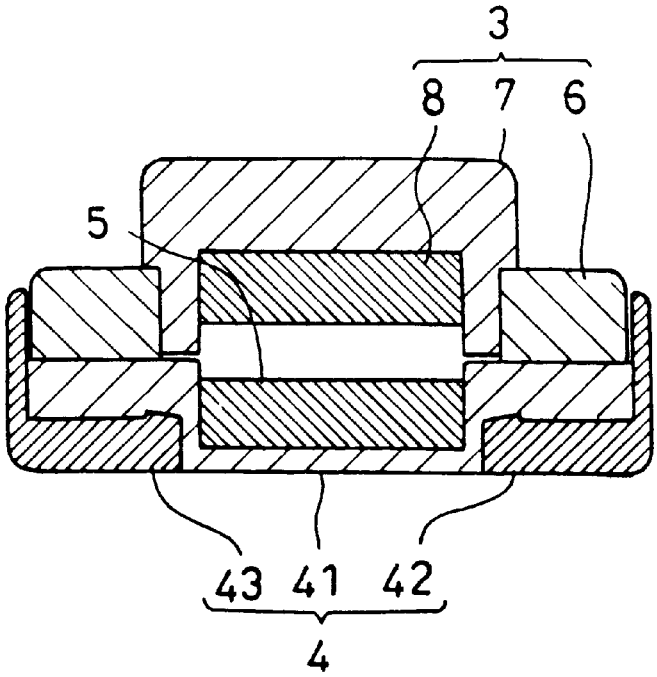
FIG. 9 is a view illustrating still another embodiment.

Furthermore, although the extension 4*b* of the inner ring 2 is bent radially outward to retain the outer ring 3 around it in the above embodiment, this aspect may also be modified. For example, as shown in FIG. 9, the inner ring body 4 may be made up of a first member 41 whose sectional configuration resembles an "ohm" symbol, a second member 42 which is generally L-shaped in cross section and a third member 43 which is generally L-shaped in cross-section. In this case, the finger ring can be completed by the following procedure.

Figure 10:
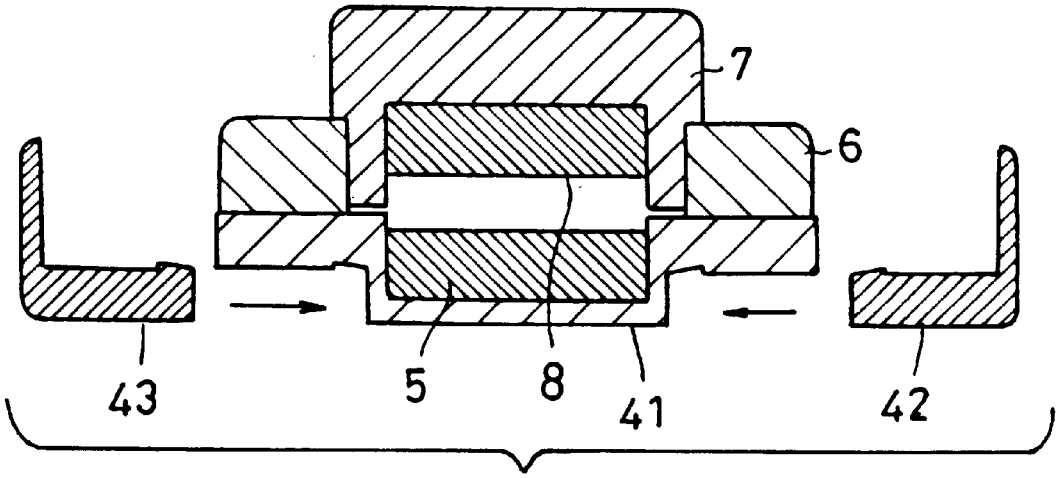
FIG. 10 is a view illustrating the method for manufacturing the finger ring shown in FIG. 9.

First, the mounting members 7 carrying the magnets 8 are attached to the outer ring body 6. The magnets 5 are then set in the first member 41 and secured in position. Thereafter, the outer ring 3 is set around the first member 41 and, after positioning, the second member 42 is fitted from the right-hand side of the first member 41 as indicated by the arrowmark in FIG. 10 and the first member 41 and the second member 42 are rigidly secured to each other. Similarly, the third member 43 is fitted from the left-hand side of the first member 41 and the first member 41 and the third member 43 are rigidly secured to each other. In this embodiment, the operation of bending a part of the inner ring is not involved and, therefore, a more neatly finished finger ring is obtained.

INDUSTRIAL APPLICABILITY

Since the finger ring of the invention is a double-ring structure consisting of an inner ring and an outer ring, with magnets being disposed on the outer circumference of the inner ring and the inner circumference of the outer ring, the finger ring not only functions as an accessory but offers the fun of manipulation and the benefit of a sedative effect.

What is claimed is:

1. A ring assembly for encircling a finger, said ring assembly comprising, in combination, a radially inner ring and a radially outer ring, each of said rings having a diameter, the diameter of the radially outer ring, being larger than the diameter of the radially inner ring, said rings being concentric and being located in the same plane, each of said rings defining an outermost circumferential surface, said rings each being adapted to encircle a finger, said circumferential surfaces of said rings facing each other radially and being separated from each other by at least a radial working clearance space so as to be coaxially rotatable relative to each other, a plurality of magnets mounted fixedly in said radially outer ring and a plurality of magnets mounted fixedly in said radially inner ring, said magnets being disposed respectively adjacent the radial working clearance space separating said radially inner ring from said radially outer ring, said plurality of magnets being also spaced circumferentially apart, one of said inner ring and said outer ring having at least one portion extending radially beyond a portion of said other ring, whereby said inner and outer rings are kept in approximate axial alignment with each other.

2. A ring assembly as defined in claim 1, wherein said plurality of magnets comprises four magnets in each ring.

3. A ring assembly as defined in claim 1, wherein said radially outer ring includes at least one precious stone mounted therein.

4. A ring assembly as defined in claim 1, wherein said radially inner ring is at least slightly axially longer than said radially outer ring, said radially inner ring including two upturned end portions, each extending radially beyond a portion of said outer ring.

5. A ring assembly as defined in claim 1, wherein said radially outer ring includes axially outermost portions extending axially beyond portions of said inner ring, said axially outermost portions of said radially outer ring also extending radially inwardly over portions of said radially inner ring.

6. A ring assembly as defined in claim 1, wherein said radially outer ring includes an outer radial face having a plurality of raised formations thereon.

7. A ring assembly as defined in claim 1, wherein said radially inner ring includes at least one grooved portion, said grooved portion further including a matching insert portion with a radial flange portion extending radially outwardly beyond a portion of said radially outer ring, whereby said radially outer ring is axially secured against movement.

8. A ring assembly as defined in claim 7, wherein said radial flange portion is circumferentially continuous.

9. A ring assembly as defined in claim 1, wherein said radially inner ring includes two contoured grooves therein, each of said grooves having a correspondingly contoured insert placed therein, and each of said inserts lying axially outwardly of said inner ring and each having a flange extending radially beyond a portion of said radially outer ring, whereby said outer ring is secured against axial movement.

10. A ring assembly as defined in claim 9, wherein both of said radially extending flanges are circumferentially continuous.

11. A ring assembly as defined in claim 1, wherein said magnets in said radially inner ring and said magnets in said radially outer ring are oriented alike in polarity.

* * * * *